US012054308B2

(12) United States Patent
Sugawara et al.

(10) Patent No.: US 12,054,308 B2
(45) Date of Patent: Aug. 6, 2024

(54) REEL PALLET

(71) Applicants: SUMITOMO ELECTRIC WINTEC, INC., Koka (JP); HIGASHINO CO. LTD., Sakai (JP)

(72) Inventors: Jun Sugawara, Koka (JP); Youichi Nagata, Koka (JP); Hiroko Higashino, Sakai (JP)

(73) Assignees: SUMITOMO ELECTRIC WINTEC, INC., Koka (JP); HIGASHINO CO. LTD., Sakai (JP)

( * ) Notice: Subject to any disclaimer, the term of this patent is extended or adjusted under 35 U.S.C. 154(b) by 0 days.

(21) Appl. No.: 17/766,581

(22) PCT Filed: Nov. 25, 2019

(86) PCT No.: PCT/JP2019/045956

§ 371 (c)(1),
(2) Date: Apr. 5, 2022

(87) PCT Pub. No.: WO2021/106035

PCT Pub. Date: Jun. 3, 2021

(65) Prior Publication Data

US 2024/0101309 A1 Mar. 28, 2024

(51) Int. Cl.
*B65D 19/44* (2006.01)
*B65D 19/00* (2006.01)

(52) U.S. Cl.
CPC ..... *B65D 19/44* (2013.01); *B65D 19/0034* (2013.01); *B65D 2519/00014* (2013.01); *B65D 2519/00049* (2013.01); *B65D 2519/00268* (2013.01); *B65D 2519/00815* (2013.01)

(58) Field of Classification Search
CPC .. B65D 2519/0815; B65D 2519/00014; B65D 19/44
USPC ..... 108/55.3
See application file for complete search history.

(56) References Cited

U.S. PATENT DOCUMENTS 2,803,363 A * 8/1957 Hutchinson ..... B66F 9/19 108/55.3
3,460,684 A * 8/1969 Almasy ..... B21C 47/24 410/121
3,753,407 A * 8/1973 Tilseth ..... B65D 19/44 410/97
4,195,732 A * 4/1980 Bell ..... B65D 19/44 206/443

(Continued)

FOREIGN PATENT DOCUMENTS

JP H08-005482 B2 1/1996
JP 2003-137288 A 5/2003

(Continued)

*Primary Examiner* — Jose V Chen
(74) *Attorney, Agent, or Firm* — Oliff PLC

(57) ABSTRACT

At least a surface of a reel pallet is made of resin. When a distance in a first direction between a reel supported by a first reel support and a reel supported by a second reel support is denoted by La, a distance in the first direction between an outer edge of the reel supported by the second reel support and a fourth side of an arrangement surface is denoted by Lb1, and a distance in the first direction between an end surface of the reel supported by the first reel support and a second side of the arrangement surface is denoted by Lb2, the reel pallet satisfies a relationship of $1<La/(Lb\mathbf{1}+Lb\mathbf{2})<3$.

11 Claims, 4 Drawing Sheets

(56) References Cited

U.S. PATENT DOCUMENTS 4,305,508 A * 12/1981 Rodgers ..... B65D 85/68 248/346.02
4,488,649 A * 12/1984 Mark ..... A47B 81/007 211/49.1
4,747,495 A * 5/1988 Hoss ..... B25H 1/0007 108/55.3
4,832,196 A * 5/1989 Butler ..... B65D 19/44 206/394
5,193,700 A * 3/1993 Lyman ..... B65D 19/44 206/386
5,413,054 A * 5/1995 Collins ..... B65D 19/44 108/55.3
5,515,977 A * 5/1996 Lambert ..... B65D 19/44 206/397
6,231,284 B1 * 5/2001 Kordel ..... B65D 90/006 108/55.3
6,361,013 B1 * 3/2002 Smith ..... B60P 7/08 248/346.02
6,379,107 B1 * 4/2002 Iwasaki ..... B65D 19/44 108/55.3
6,550,741 B1 * 4/2003 Cottone ..... B61D 45/003 108/51.11
2005/0247828 A1 * 11/2005 Tzur ..... B65D 19/44 248/68.1
2007/0012588 A1 * 1/2007 Smolenski ..... B65D 19/44 206/386
2007/0221593 A1 * 9/2007 Apps ..... B65D 19/44 211/74
2010/0078429 A1 * 4/2010 Strang ..... B60P 7/12 108/55.3
2015/0360810 A1 * 12/2015 DiSabantonio, III .. B65D 19/44 108/55.3
2016/0113396 A1 * 4/2016 Wilhelmsen ..... B65D 19/385 211/72
2016/0130032 A1 * 5/2016 Pratt ..... F16L 3/02 108/51.3
2016/0251114 A1 * 9/2016 Lee ..... B65D 85/06 108/55.3
2017/0071336 A1 * 3/2017 Wilhelmsen ..... B65D 19/0097
2019/0233163 A1 * 8/2019 Hamner ..... B65H 75/02
2020/0047972 A1 * 2/2020 Bevier ..... B65D 85/66
2023/0028632 A1 * 1/2023 Samaras ..... B65H 16/021
2023/0234750 A1 * 7/2023 Apps ..... B65D 19/385 108/55.1

FOREIGN PATENT DOCUMENTS

JP 2004-042932 A 2/2004
JP 2005-041523 A 2/2005
JP 1503582 S 7/2014
JP 2019-085159 A 6/2019
JP 2019-094076 A 6/2019
WO 2018/168452 A1 9/2018

* cited by examiner

REEL PALLET

TECHNICAL FIELD

The present disclosure relates to a reel pallet.

BACKGROUND ART

As a conventional reel pallet, there is known a wooden reel pallet which is obtained by fixing a plurality of wood materials with nails. For example, Design Registration No. 1503582 (PTL 1) discloses a reel pallet.

CITATION LIST

Patent Literature

PTL 1: Design Registration No. 1503582

SUMMARY OF INVENTION

A reel pallet according to an aspect of the present disclosure includes a base and a plurality of reel supports, and at least a surface of the reel pallet is made of resin. The base has an arrangement surface. The plurality of reel supports are formed on the arrangement surface of the base. The plurality of reel supports includes a first reel support, a second reel support, a third reel support, and a fourth reel support. The first reel support and the second reel support are adjacent to each other in a first direction, and the third reel support and the fourth reel support are adjacent to each other in the first direction. The first reel support and the third reel support are adjacent to each other in a second direction intersecting the first direction, and the second reel support and the fourth reel support are adjacent to each other in the second direction. The plurality of reel supports are formed in such a manner that an axis of a reel supported by the first reel support and an axis of a reel supported by the fourth reel support extend in the first direction, and an axis of a reel supported by the second reel support and an axis of a reel supported by the third reel support extend in the second direction. When a distance in the first direction between the reel supported by the first reel support and the reel supported by the second reel support is denoted by La, a distance in the first direction between an outer edge of the reel supported by the second reel support and located on the side opposite to the first reel support and an outer edge of the base is denoted by Lb1, and a distance in the first direction between an end surface of the reel supported by the first reel support and located on the side opposite to the second reel support and an outer edge of the base is denoted by Lb2, the reel pallet satisfies a relationship of $1<La/(Lb1+Lb2)<3$.

DETAILED DESCRIPTION

Figure 1:
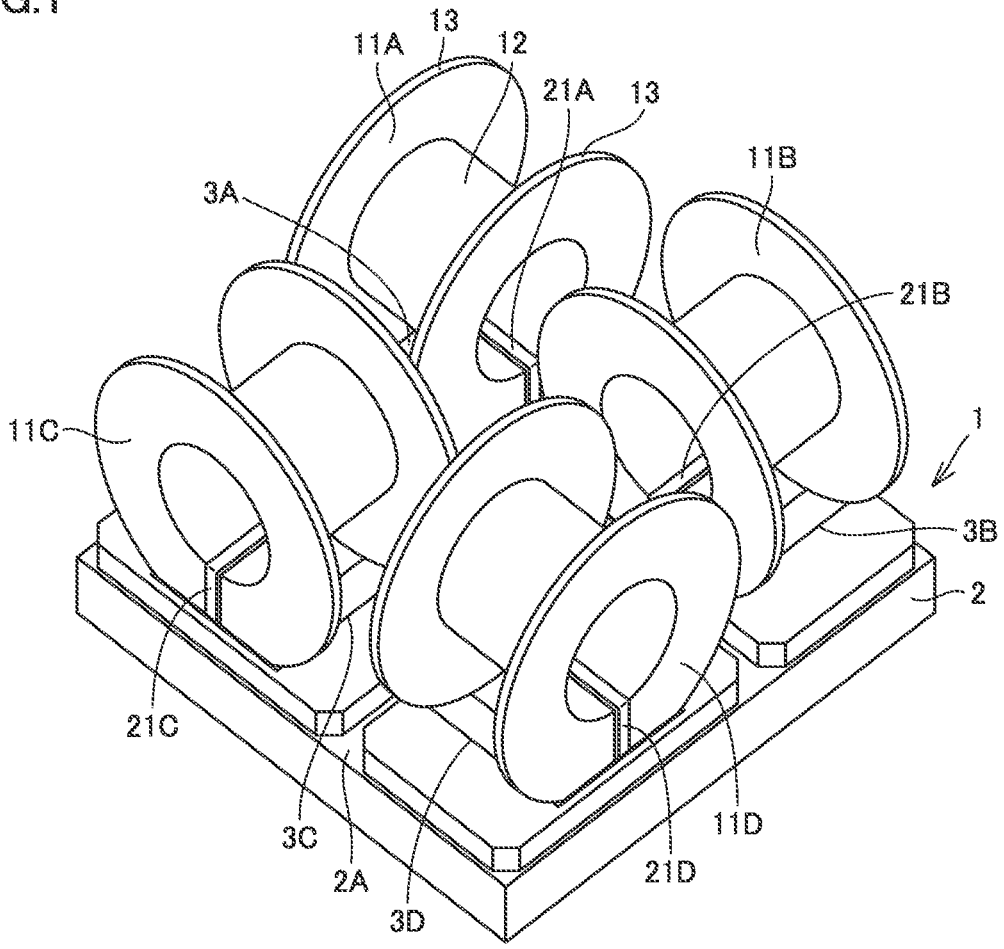
FIG. 1 is a perspective view illustrating that a plurality of reels are supported on a reel pallet according to an embodiment.

Problem to be Solved by the Present Disclosure

However, the wooden reel pallet is not sufficient in durability. Therefore, it required to improve the durability of the reel pallet.

In addition, it is desired to prevent the reel from being damaged when the reel is loaded into or unloaded from the reel pallet while preventing the reel pallet from becoming larger in size.

An object of one aspect of the present disclosure is to provide a reel pallet which is superior in durability and is capable of preventing a reel from being damaged when the reel is loaded into or unloaded from the reel pallet while preventing the reel pallet from becoming larger in size.

Advantageous Effect of the Present Disclosure

According to the present disclosure, it is possible to provide a reel pallet which is superior in durability and is capable of preventing a reel from being damaged when the reel is loaded into or unloaded from the reel pallet while preventing the reel pallet from becoming larger in size.

DESCRIPTION OF EMBODIMENTS

First, embodiments of the present disclosure will be summarized.

(1) A reel pallet according to an aspect of the present disclosure includes a base and a plurality of reel supports, and at least a surface of the reel pallet is made of resin. The base has an arrangement surface. The plurality of reel supports are formed on the arrangement surface of the base. The plurality of reel supports includes a first reel support, a second reel support, a third reel support, and a fourth reel support. The first reel support and the second reel support are adjacent to each other in a first direction, and the third reel support and the fourth reel support are adjacent to each other in the first direction. The first reel support and the third reel support are adjacent to each other in a second direction intersecting the first direction, and the second reel support and the fourth reel support are adjacent to each other in the second direction. The plurality of reel supports are formed in such a manner that an axis of a reel supported by the first reel support and an axis of a reel supported by the fourth reel support extend in the first direction, and an axis of a reel supported by the second reel support and an axis of a reel supported by the third reel support extend in the second direction. When a distance in the first direction between the reel supported by the first reel support and the reel supported by the second reel support is denoted by La, a distance in the first direction between an outer edge of the reel supported by the second reel support and located on the side opposite to the first reel support and an outer edge of the base is denoted by Lb1, and a distance in the first direction between an end surface of the reel supported by the first reel support and located on the side opposite to the second reel support and an outer edge of the base is denoted by Lb2, the reel pallet satisfies a relationship of $1<La/(Lb1+Lb2)<3$.

As described above, since at least the surface of the reel pallet is made of resin, it is possible to improve the durability of the reel pallet of the present disclosure as compared with the wooden reel pallet.

If La/(Lb1+Lb2) is 1 or less, when the reels are loaded into or unloaded from the reel pallet, a holder for holding a reel may collide with another reel, and the reels may collide with each other. If La/(Lb1+Lb2) is 3 or more, the distance between the reels may become larger, which makes the reel pallet larger in size.

Therefore, the reel pallet according to an aspect of the present disclosure is configured to satisfy the relationship of 1<La/(Lb1+Lb2)<3. Thus, when the reels are loaded into or unloaded from the reel pallet, it is possible to prevent the holder from colliding with the reel and prevent the reels from colliding with each other while preventing the reel pallet from becoming larger in size.

(2) In the reel pallet described in the above (1), each of the plurality of reel supports is formed with a recess into which a reel is loaded, and the recess includes a curved portion which supports the reel in the recess, and in a plan view when viewed from a direction orthogonal to the arrangement surface, a reel-to-reel distance La in the first direction between a position shifted from an axis of the reel supported by the second reel support toward the first reel support by a radius of curvature R of the curved portion and a position of a side wall of the recess of the first reel support closer to the second reel support is (80×2×R)/600 or more and (120×2×R)/600 or less.

Thus, it is possible to prevent the reel from being damaged when the reel is loaded into or unloaded from the reel pallet while making the reel pallet smaller in size.

(3) In the reel pallet described in the above (2), the reel-to-reel distance La is 10 mm or more and 140 mm or less.

Thus, when the diameter of a flange member of the reel is 600 mm, it is possible to prevent the reel from being damaged when the reel is loaded into or unloaded from the reel pallet while making the reel pallet smaller in size.

(4) In the reel pallet described in the above (3), in the plan view, a distance in the first direction between an outer edge of the base, which is located on the side opposite to the second reel support with respect to the first reel support, and the recess of the first reel support, is 60 mm or less.

Thus, it is possible to make the base smaller in size, which makes it possible to easily transport the reel pallet.

(5) In the reel pallet described in the above (1), the base and the plurality of reel supports are integrally formed.

Thus, it is possible to form the base and the reel supports by integral molding, which makes the reel pallet higher in strength.

(6) In the reel pallet described in the above (2), each of the plurality of reel supports is formed at a portion protruding from the arrangement surface of the base.

Thus, it is possible to form the recess for inserting the reel at the protruding portion, which makes it possible to reduce the thickness of the base.

(7) In the reel pallet described in the above (6), the curved portion of each of the plurality of reel supports is constituted by two curved supports separated from each other.

Thus, it is possible to simplify the shape of the curved portion.

(8) In the reel pallet described in the above (6), the curved portion of each of the plurality of reel supports is constituted by four curved supports separated from each other.

Thus, it is possible to support a reel at four points, which makes it possible to support the reel more stably.

(9) In the reel pallet described in the above (6), the curved portion of each of the plurality of reel supports is constituted by a single curved support.

Thus, it is possible to simplify the shape of the curved portion, and it is also possible to increase the length for supporting the reel in the circumferential direction.

(10) In the reel pallet described in the above (1), each of the plurality of reel supports is formed as a recess recessed from the arrangement surface of the base.

Thus, there is no need to form a protruding portion on the arrangement surface of the base, which makes it possible to simplify the shape of the reel pallet.

(11) In the reel pallet described in the above (1), each of the plurality of reel supports is configured to support a reel wound with insulated wires.

Thus, it is possible to transport and/or store the reel pallet while a plurality of reels, each of which is wound with insulated wires, are being supported thereon.

DETAILS OF EMBODIMENT OF THE PRESENT DISCLOSURE

Hereinafter, an embodiment of the present disclosure will be described in detail with reference to the drawings. It should be noted that in the following description and the drawings, the same or corresponding components are denoted by the same reference numerals, and the description thereof will not be repeated. In the drawings, some components may be omitted or simplified for the convenience of description. At least a part of the embodiment and at least a part of the modification may be arbitrarily combined with each other.

(Configuration of Reel Pallet)

First, the configuration of a reel pallet 1 according to the present embodiment will be described with reference to FIGS. 1 to 4.

Figure 2:
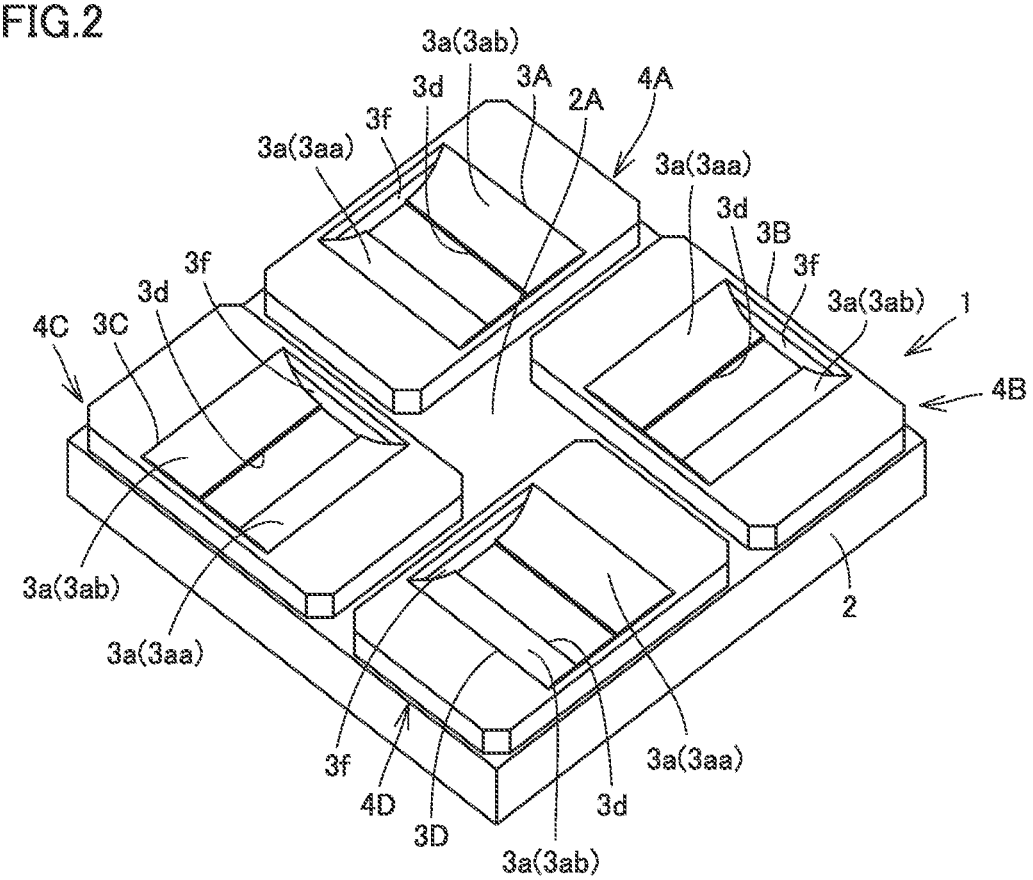
FIG. 2 is a perspective view illustrating the configuration of the reel pallet according to the present embodiment.
Figure 3:
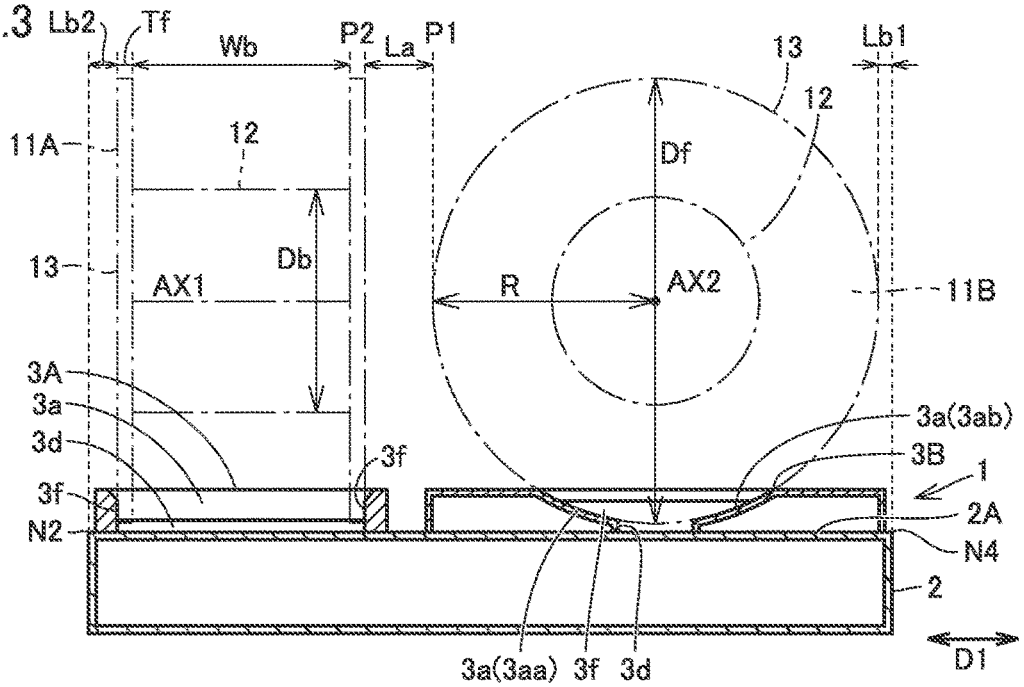
FIG. 3 is a schematic cross-sectional view taken along line III-III of FIG. 4.
Figure 4:
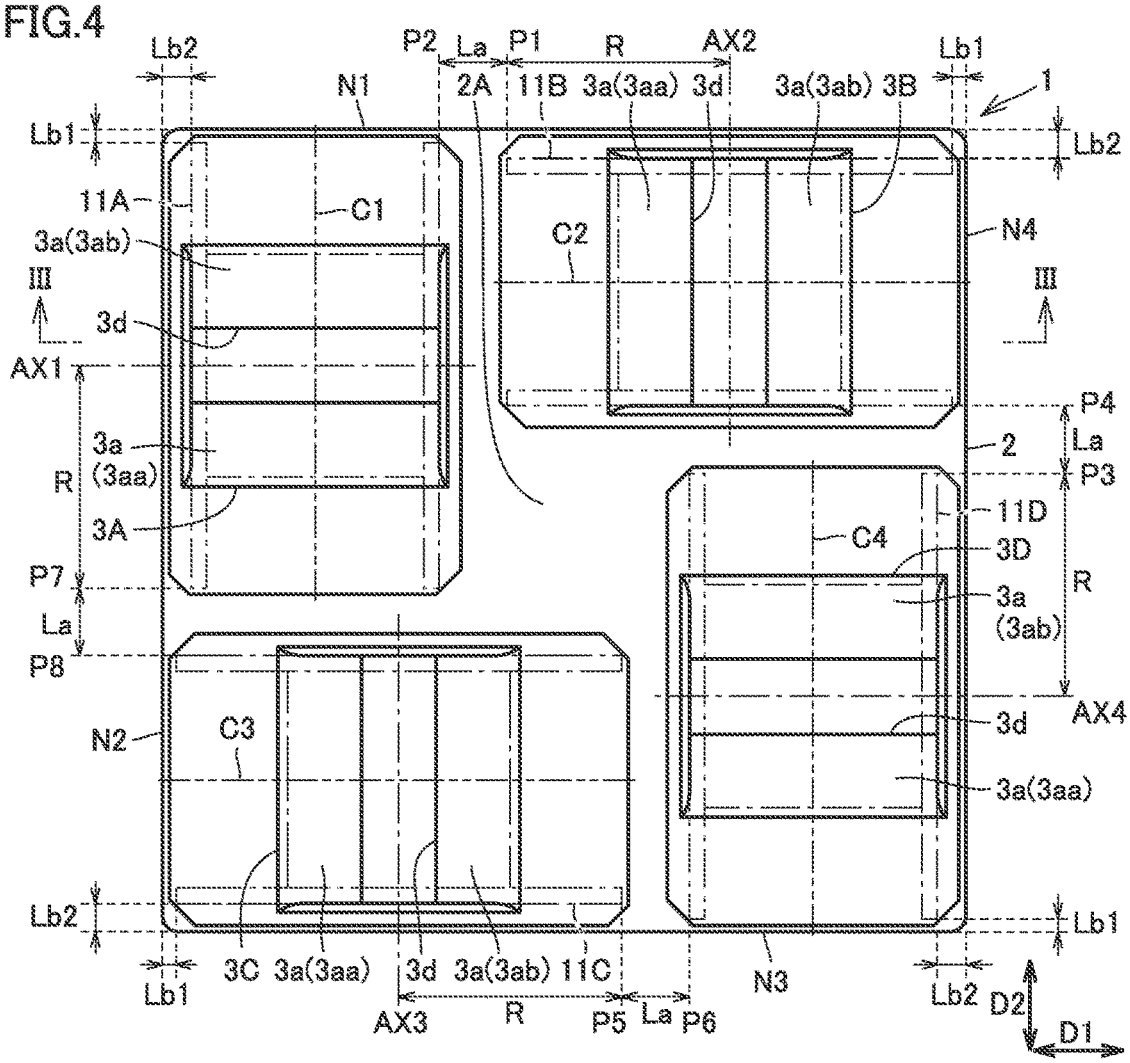
FIG. 4 is a plan view illustrating the configuration of the reel pallet according to the present embodiment.

FIG. 1 is a perspective view illustrating that a plurality of reels are supported on the reel pallet according to the present embodiment, FIG. 2 is a perspective view illustrating the configuration of the reel pallet according to the present embodiment, FIG. 4 is a plan view illustrating the configuration of the reel pallet according to the present embodiment, and FIG. 3 is a schematic cross-sectional view taken along line III-III of FIG. 4.

In FIGS. 3 and 4, the outer profile of each of reels 11A to 11D, an axis AX1, an axis AX2, an axis AX3 and an axis AX4 of the reels 11A to 11D, respectively, are denoted by an one-dot chain line. In FIG. 4, a center line C1, a center line C2, a center line C3 and a center line C4 of the plurality of reel supports 3A to 3D, respectively, are denoted by a two-dot chain line.

As illustrated in FIG. 1, at least a surface of the reel pallet 1 is made of resin. The entire part of the reel pallet 1 may be made of resin. Alternatively, the reel pallet 1 may be made of wood, and the surface of the wood may be coated with resin.

The resin to be used is not particularly limited, and it may be, for example, polyethylene, polypropylene, ABS (Acrylonitrile Butadiene Styrene) resin or polyether ether ketone alone or in any combination. Further, in order to improve the strength of the resin, a filler such as glass fiber or carbon fiber may be appropriately added to the resin.

For example, four reels 11A to 11D are supported on an arrangement surface 2A of the reel pallet 1. Each of the four reels 11A to 11D is, for example, wound with insulated wires (not shown).

Each of the four reels 11A to 11D has a main body 12 and a pair of flange members 13. The main body 12 has a cylindrical shape. The flange member 13 is formed at both ends of the main body 12.

Each of the pair of flange members 13 has an annular shape. Each of the pair of flange members 13 protrudes from the outer peripheral surface of the main body 12 outward. The outer diameter of each of the pair of flange members 13 is larger than the outer diameter of the main body 12.

Each of the four reels 11A to 11D has a through hole penetrating from one end of each reel to the other end thereof. The through hole penetrates the main body 12 and the pair of flange members 13.

Each of the four reels 11A, 11B, 11C and 11D may be fixed on the reel pallet 1 by, for example, a belt 21A, 21B, 21C or 21D. Each of the belts 21A, 21B, 21C and 21D passes through the through hole of the reel 11A, 11B, 11C or 11D.

The reel pallet 1 includes a base 2 and a plurality of reel supports 3A, 3B, 3C, and 3D. At least the surface of the base 2 and the surface of each of the plurality of reel supports 3A to 3D are made of resin, for example. The entire part of the base 2 and the entire part of each of the plurality of reel supports 3A to 3D may be made of resin. The base 2 and each of the plurality of reel supports 3A to 3D may be made of wood, and the surface of the wood may be coated with resin.

As illustrated in FIG. 2, the base 2 has an upper surface 2A, a lower surface opposed to the upper surface 2A, and side surfaces connected to both the upper surface 2A and the lower surface. Each of the upper surface 2A and the lower surface opposed to each other has, for example, a quadrangular shape. The upper surface 2A of the base 2 serves as the arrangement surface 2A on which the plurality of reels 11A to 11D are arranged.

The base 2 may be a single-side base in which the reels 11A to 11D may be arranged only on the upper surface 2A. Alternatively, the base 2 may be a double-side base in which the reels 11A to 11D may be arranged on both the upper surface 2A and the lower surface.

The arrangement surface 2A of the base 2 is formed with a plurality of reel supports 3A to 3D. The plurality of reel supports 3A to 3D includes a first reel support 3A, a second reel support 3B, a third reel support 3C, and a fourth reel support 3D.

The first reel support 3A is configured to support the reel 11A. The second reel support 3B is configured to support the reel 11B. The third reel support 3C is configured to support the reel 11C. The fourth reel support 3D is configured to support the reel 11D.

The plurality of reel supports 3A to 3D may be constituted by trays 4A to 4D, respectively. Each of the trays 4A to 4D may be attached to or detached from the arrangement surface 2A of the base 2.

After each of the trays 4A to 4D is attached to the arrangement surface 2A of the base 2, each of the trays 4A to 4D protrudes upward from the arrangement surface 2A. Each of the plurality of reel supports 3A to 3D is formed at the portion protruding upward from the arrangement surface 2A of the base 2.

Each of the plurality of reel supports 3A to 3D may be formed integrally with the base 2 via integral molding with the base 2.

Each of the plurality of reel supports 3A to 3D is formed with a recess into which each of the reels 11A to 11D is loaded. Each of the plurality of reel supports 3A to 3D includes a curved portion 3*a*, a through hole 3*d*, and a pair of side walls 3*f*.

The curved portion 3*a*, the through hole 3*d* and the pair of side walls 3*f* are disposed in a recess constituting each of the plurality of reel supports 3A, 3B, 3C, and 3D.

As illustrated in FIG. 3, the curved portion 3*a* is configured to support the outer peripheral surface of the flange member 13 of each of the reels 11A to 11D. Therefore, the curved portion 3*a* has substantially the same radius of curvature R as the outer circumference of the flange member 13.

The curved portion 3*a* is constituted by, for example, two curved supports 3*aa* and 3*ab*. Each of the two curved supports 3*aa* and 3*ab* has substantially the same radius of curvature R as the outer circumference of the flange member 13 of each of the reels 11A to 11D. The two curved supports 3*aa* and 3*ab* are separated from each other in the circumferential direction of the outer circumference of the flange member 13 of each of the reels 11A to 11D.

The through hole 3*d* is provided between the two curved supports 3*aa* and 3*ab*.

The through hole 3*d* penetrates each of the reel supports 3A to 3D between the two curved supports 3*aa* and 3*ab*. Thereby, the arrangement surface 2A of the base 2 is exposed from the through hole 3*d*. The through hole 3*d* is configured to allow each of the belts 21A to 21D (FIG. 1) to pass through. Each of the belts 21A to 21D can be fixed to the base 2 by passing through the through hole 3*d*.

As illustrated in FIG. 2, the pair of side walls 3*f* is arranged to sandwich the two curved supports 3*aa* and 3*ab* and the through hole 3*d*. Specifically, one end of the two curved supports 3*aa*, 3*ab* and one end of the through hole 3*d* are connected to one of the pair of side walls 3*f*, and the other end of the two curved supports 3*aa*, 3*ab* and the other end of the through hole 3*d* are connected to the other one of the pair of side walls 3*f*. The pair of side walls 3*f* are opposed to each other.

As illustrated in FIG. 3, the diameter Df of the flange member of each of the reels 11A to 11D is, for example, 600 mm. The diameter of the main body of each of the reels 11A to 11D is, for example, 400 mm. The width Wb of the main body of each of the reels 11A to 11D is, for example, 280 mm. The thickness Tf of the flange member of each of the reels 11A to 11D is, for example, 30 mm.

As illustrated in FIG. 4, when viewed from a viewpoint orthogonal to the arrangement surface 2A of the base 2 (a plan view), the first reel support 3A and the second reel support 3B are adjacent to each other in a first direction D1. In the plan view, the third reel support 3C and the fourth reel support 3D are adjacent to each other in the first direction D1.

In the plan view, the first reel support 3A and the third reel support 3C are adjacent to each other in a second direction D2. The second direction D2 intersects (for example, is orthogonal to) the first direction D1. In the plan view, the second reel support 3B and the fourth reel support 3D are adjacent to each other in the second direction D2.

The curved portion 3*a* of the first reel support 3A is curved in the second direction. Thus, the first reel support 3A is formed in such a manner that an axis AX1 of the reel 11A supported by the first reel support 3A extends in the first direction D1.

The curved portion 3*a* of the fourth reel support 3D is curved in the second direction. Thus, the fourth reel support 3D is formed in such a manner that an axis AX4 of the reel 11D supported by the fourth reel support 3D extends in the first direction D1.

The curved portion 3*a* of the second reel support 3B is curved in the first direction. Thus, the second reel support 3B is formed in such a manner that an axis AX2 of the reel 11B supported by the second reel support 3B extends in the second direction D2.

The curved portion 3*a* of the third reel support 3C is curved in the first direction. Thus, the third reel support 3C is formed in such a manner that an axis AX3 of the reel 11C supported by the third reel support 3C extends in the second direction D2.

In the plan view, the first side N1, the second side N2, the third side N3, and the fourth side N4 of the arrangement surface 2A constitute the outer edge of the quadrangular-shaped arrangement surface 2A. Also, the first side N1, the second side N2, the third side N3, and the fourth side N4 of the arrangement surface 2A constitute the outer edge of the base 2. The first side N1 and the third side N3 are opposite to each other (opposite sides). The second side N2 and the fourth side N4 are opposite to each other (opposite sides).

The first reel support 3A and the second reel support 3B are arranged along the first side N1. The first reel support 3A and the third reel support 3C are arranged along the second side N2. The second reel support 3B and the fourth reel support 3D are arranged along the fourth side N4. The third reel support 3C and the fourth reel support 3D are arranged along the third side N3.

Each of the axis AX1 of the reel 11A and the axis AX4 of the reel 11D is, for example, parallel to each of the first side N1 and the third side N3, and is, for example, orthogonal to each of the second side N2 and the fourth side N4. Each of the axis AX2 of the reel 11B and the axis AX3 of the reel 11C is, for example, parallel to each of the second side N2 and the fourth side N4, and is, for example, orthogonal to each of the first side N1 and the third side N3.

A center line C1, which pass through a middle point of the recess of the first reel support 3A and extends in the second direction D2, is located closer to the second side N2 than the axis AX3. A center line C2, which pass through a middle point of the recess of the second reel support 3B and extends in the first direction D1, is located closer to the first side N1 than the axis AX1.

A center line C3, which pass through a middle point of the recess of the third reel support 3C and extends in the first direction D1, is located closer to the third side N3 than the axis AX4. A center line C4, which pass through a middle point of the recess of the fourth reel support 3D and extends in the second direction D2, is located closer to the fourth side N4 than the axis AX2.

The center line C1 is an imaginary line that divides the recess of the first reel support 3A into two equal parts in the first direction D1, and is located at the center of the pair of flange members 13 of the reel 11A in the plan view. The center line C2 is an imaginary line that divides the recess of the second reel support 3B into two equal parts in the second direction D2, and is located at the center of the pair of flange members 13 of the reel 11B in the plan view.

The center line C3 is an imaginary line that divides the recess of the third reel support 3C into two equal parts in the second direction D2, and is located at the center of the pair of flange members 13 of the reel 11C in the plan view. The center line C4 is an imaginary line that divides the recess of the fourth reel support 3D into two equal parts in the first direction D1, and is located at the center of the pair of flange members 13 of the reel 11D in the plan view.

As illustrated in FIG. 3, a distance in the first direction D1 between the reel 11A supported by the first reel support 3A and the reel 11B supported by the second reel support 3B is denoted by La. A distance in the first direction D1 between an outer edge of the reel 11B supported by the second reel support 3B and located on the side opposite to the first reel support 3A and an outer edge of the base 2 (i.e., the fourth side N4 of the arrangement surface 2A) is denoted by Lb1. A distance in the first direction D1 between an end face of the reel 11A supported by the first reel support 3A and located on the side opposite to the second reel support 3B and an outer edge of the base 2 (i.e., the second side N2 of the arrangement surface 2A) is denoted by Lb2. Then, the reel pallet 1 of the present embodiment satisfies the relationship of $1<La/(Lb1+Lb2)<3$.

The distance La may be determined from a position P1 of the outer edge of the reel 11B and a position P2 of the end face of the reel 11A. The position P1 of the reel 11B may be determined from the radius of curvature R of the curved portion 3*a* of the second reel support 3B and the position of the axis AX2 of the reel 11B. The position of the axis AX2 of the reel 11B may be determined from the curvature of the curved portion 3*a* of the second reel support 3B. Specifically, the outer circumferential shape of the flange member 13 of the reel 11B may be determined from the curvature of the curved portion 3*a* of the second reel support 3B, and the axis AX2 is positioned above the lowerest point of the outer circumference of the flange member 13 in the direction orthogonal to the arrangement surface 2A by the radius of curvature R.

The position P2 of the end face of the reel 11A may be determined from the position of the side wall 3*f* of the recess of the first reel support 3A. This is because that when the reel 11A is inserted into the recess of the first reel support 3A, the end face of the flange member 13 of the reel 11 is in contact with or close to the side wall 3*f* of the recess.

The distance Lb1 may be determined from the position of the outer edge of the reel 11B and the position of the fourth side N4 of the arrangement surface 2A. The position of the outer edge of the reel 11B may be determined in the same manner as the position P1.

The distance Lb2 may be determined from the position of the end face of the reel 11A and the position of the second side N2 of the arrangement surface 2A. The position of the end face of the reel 11A may be determined in the same manner as the position P2.

As illustrated in FIG. 4, similarly to the above, a distance in the second direction D2 between the reel 11B supported by the second reel support 3B and the reel 11D supported by the fourth reel support 3D is denoted by La. A distance in the second direction D2 between an outer edge of the reel 11D supported by the fourth reel support 3D and located on the side opposite to the second reel support 3B and an outer edge of the base 2 (i.e., the third side N3 of the arrangement surface 2A) is denoted by Lb1. A distance in the second direction D2 between an end face of the reel 11B supported by the second reel support 3B and located on the side opposite to the fourth reel support 3D and an outer edge of the base 2 (i.e., the first side N1 of the arrangement surface 2A) is denoted by Lb2. Then, the reel pallet 1 of the present embodiment satisfies the relationship of $1<La/(Lb1+Lb2)<3$.

A distance in the first direction D1 between the reel 11D supported by the fourth reel support 3D and the reel 11C supported by the third reel support 3C is denoted by La. A distance in the first direction D1 between an outer edge of the reel 11C supported by the third reel support 3C and located on the side opposite to the fourth reel support 3D and an outer edge of the base 2 (i.e., the second side N2 of the arrangement surface 2A) is denoted by Lb1. A distance in the first direction D1 between an end face of the reel 11D supported by the fourth reel support 3D and located on the side opposite to the third reel support 3C and an outer edge of the base 2 (i.e., the fourth side N4 of the arrangement surface 2A) is denoted by Lb2. Then, the reel pallet 1 of the present embodiment satisfies the relationship of $1<La/(Lb1+Lb2)<3$.

A distance in the second direction D2 between the reel 11C supported by the third reel support 3C and the reel 11A supported by the first reel support 3A is denoted by La. A distance in the second direction D2 between an outer edge of the reel 11A supported by the first reel support 3A and located on the side opposite to the third reel support 3C and an outer edge of the base 2 (i.e., the first side N1 of the arrangement surface 2A) is denoted by Lb1. A distance in the second direction D2 between an end face of the reel 11C supported by the third reel support 3C and located on the side opposite to the first reel support 3A and an outer edge of the base 2 (i.e., the third side N3 of the arrangement surface 2A) is denoted by Lb2. Then, the reel pallet 1 of the present embodiment satisfies the relationship of $1<La/(Lb1+Lb2)<3$.

In the plan view, the reel-to-reel distance in the first direction D1 between the position P1 shifted from the axis AX2 of the reel 11B supported by the second reel support 3B toward the first reel support 3A by the radius of curvature R of the curved portion 3*a* and the position P2 of the side wall of the recess of the first reel support 3A closer to the second reel support 3B is (80×2×R)/600 or more and (120×2×R)/600 or less. The reel-to-reel distance is equal to the distance La in the first direction D1 between the reels 11A and 11B. The reel-to-reel distance La is, for example, 10 mm or more and 140 mm or less. The reel-to-reel distance La is preferably 80 mm or more and 120 mm or less, for example.

In the plan view, the reel-to-reel distance in the second direction D2 between the position P3 shifted from the axis AX4 of the reel 11D supported by the fourth reel support 3D toward the second reel support 3B by the radius of curvature R of the curved portion 3*a* and the position P4 of the side wall of the recess of the second reel support 3B closer to the fourth reel support 3D is (80×2×R)/600 or more and (120×2×R)/600 or less. The reel-to-reel distance is equal to the distance La in the second direction D2 between the reels 11B and 11D. The reel-to-reel distance La is, for example, 10 mm or more and 140 mm or less. The reel-to-reel distance La is preferably 80 mm or more and 120 mm or less, for example.

In the plan view, the reel-to-reel distance in the first direction D1 between the position P5 shifted from the axis AX3 of the reel 11C supported by the third reel support 3C toward the fourth reel support 3D by the radius of curvature R of the curved portion 3*a* and the position P6 of the side wall of the recess of the fourth reel support 3D closer to the third reel support 3C is (80×2×R)/600 or more and (120×2×R)/600 or less. The reel-to-reel distance is equal to the distance La in the first direction D1 between the reels 11C and 11D. The reel-to-reel distance La is, for example, 10 mm or more and 140 mm or less. The reel-to-reel distance La is preferably 80 mm or more and 120 mm or less, for example.

In the plan view, the reel-to-reel distance in the second direction D2 between the position P7 shifted from the axis AX1 of the reel 11A supported by the first reel support 3A toward the third reel support 3C by the radius of curvature R of the curved portion 3*a* and the position P8 of the side wall of the recess of the third reel support 3C closer to the first reel support 3A is (80×2×R)/600 or more and (120×2×R)/600 or less. The reel-to-reel distance is equal to the distance La in the second direction D2 between the reels 11A and 11C. The reel-to-reel distance La is, for example, 10 mm or more and 140 mm or less. The reel-to-reel distance La is preferably 80 mm or more and 120 mm or less, for example.

In the plan view, the distance Lb2 in the first direction D1 between an outer edge of the base2 (i.e., the second side N2 of the arrangement surface 2A), which is located on the side opposite to the second reel support 3B with respect to the first reel support 3A, and the recess of the first reel support 3A, is 60 mm or less.

In the plan view, the distance Lb2 in the second direction D2 between an outer edge of the base2 (i.e., the first side N1 of the arrangement surface 2A), which is located on the side opposite to the fourth reel support 3D with respect to the second reel support 3B, and the recess of the second reel support 3B, is 60 mm or less.

In the plan view, the distance Lb2 in the second direction D2 between an outer edge of the base2 (i.e., the third side N3 of the arrangement surface 2A), which is located on the side opposite to the first reel support 3A with respect to the third reel support 3C, and the recess of the third reel support 3C, is 60 mm or less.

In the plan view, the distance Lb2 in the first direction D1 between an outer edge of the base2 (i.e., the fourth side N4 of the arrangement surface 2A), which is located on the side opposite to the third reel support 3C with respect to the fourth reel support 3D, and the recess of the fourth reel support 3D, is 60 mm or less.

In the present embodiment, it is described that each of the two curved supports 3*aa* and 3*ab* is formed of a surface having a constant radius of curvature. However, each of the two curved supports 3*aa* and 3*ab* may be formed of a first surface having a constant radius of curvature and a second surface joined to the first surface with a step formed therebetween. The second surface may be a curved surface or a flat surface.

(First Modification)

Figure 5:
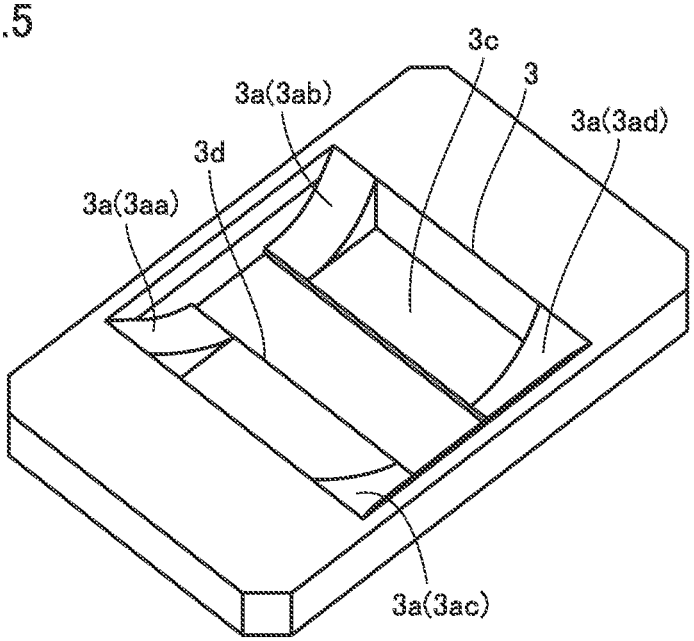
FIG. 5 is a perspective view illustrating the configuration of a curved portion which is constituted by four curved supports according to a first modification.

FIG. 5 is a perspective view illustrating the configuration of a curved portion which is constituted by four curved supports according to a first modification. As illustrated in FIG. 5, the curved portion 3*a* of the present modification is constituted by four curved supports 3*aa*, 3*ab*, 3*ac*, and 3*ad*. Each of the four curved supports 3*aa*, 3*ab*, 3*ac*, and 3*ad* has substantially the same radius of curvature R as the outer circumference of the flange member 13 of each of the reels 11A to 11D.

The curved support 3*aa* and the curved support 3*ab* are separated from each other along the circumferential direction of the outer circumference of the flange member 13 of each of the reels 11A to 11D. The curved support 3*ac* and the curved support 3*ad* are separated from each other along the circumferential direction of the outer circumference of the flange member 13 of each of the reels 11A to 11D.

The curved support 3*aa* and the curved support 3*ac* are separated from each other along the extending direction of each of the axes AX1 to AX4 of a respective one of the reels 11A to 11D supported by the curved portion 3*a*. A bottom portion 3*c* is located between the curved support 3*aa* and the curved support 3*ac*. The bottom portion 3*c* between the curved support 3*aa* and the curved support 3*ac* is a flat surface.

The curved support 3*ab* and the curved support 3*ad* are separated from each other along the extending direction of each of the axes AX1 to AX4 of a respective one of the reels 11A to 11D supported by the curved portion 3*a*. A bottom portion 3*c* is located between the curved support 3*ab* and the curved support 3*ad*. The bottom portion 3*c* between the curved support 3*ab* and the curved support 3*ad* is a flat surface.

The curved portion 3*a* may be constituted by a single curved support.

(Second Modification)

Figure 6:
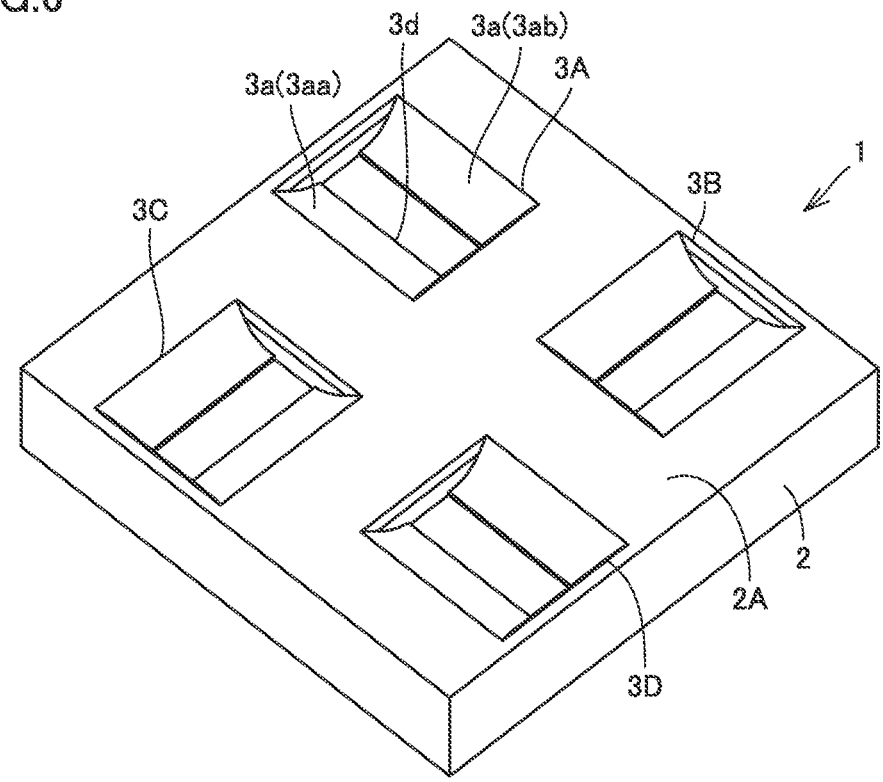
FIG. 6 is a perspective view illustrating the configuration of a reel support which is formed as a recess recessed from an arrangement surface of a base according to a second modification.

FIG. 6 is a perspective view illustrating the configuration of a reel pallet according to a second modification in which the reel support is formed as a recess recessed from the arrangement surface of the base. As illustrated in FIG. 6, in the second modification, the reel pallet 1 is constituted by the base 2 only, and does not include a tray or the like.

The arrangement surface 2A of the base 2 is formed with four reel supports 3A, 3B, 3C, and 3D. Each of the four reel supports 3A, 3B, 3C, and 3D is recessed from the arrangement surface 2A of the base 2. In this configuration, the recess formed on the arrangement surface 2A of the base 2 constitutes each of the reel supports 3A to 3D.

Since the configuration of the first modification and the configuration of the second modification are substantially the same as the configuration of the embodiment illustrated in FIGS. 1 to 4 other than those described above, the same components are denoted by the same reference numerals, and the description thereof will not be repeated.

EFFECTS

According to the present embodiment, the first modification and the second modification, since at least the surface of the reel pallet 1 is made of resin, it is possible to increase the durability of the reel pallet 1 greater than that of a conventional reel pallet made of wood.

As illustrated in FIG. 4, after each of the reels 11A to 11D is loaded into the reel pallet 1, the holder is inserted into the through hole of each of the reels 11A to 11D, and the holder is removed from the through hole of each of the reels 11A to 11D so as to unload each of the reels 11A to 11D from the reel pallet 1. Therefore, if the reel-to-reel distance La between the reels 11A to 11D is small, the holder may collide with the reels 11A to 11D and the reels 11A to 11D may collide with each other, which may damage the reels 11A to 11D.

Thus, if La/(Lb1+Lb2) is 1 or less, when the reels 11A to 11D are loaded into or unloaded from the reel pallet, the holder may collide with the reels 11A to 11D, and the reels 11A to 11D may collide with each other. If La/(Lb1+Lb2) is 3 or more, the distance between reels may become larger, which makes the reel pallet larger in size.

Therefore, the reel pallet 1 according to any of the present embodiment, the first modification and the second modification is configured to satisfy the relationship of $1<La/(Lb1+Lb2)<3$. Thus, when the reels 11A to 11D are loaded into or unloaded from the reel pallet 1, it is possible to prevent the holder from colliding with the reels 11A to 11D and prevent the reels 11A to 11D from colliding with each other while preventing the reel pallet from becoming larger in size.

Further, according to the present embodiment, the first modification and the second modification, as illustrated in FIG. 4, in the plan view, the reel-to-reel distance La in the first direction D1 between the position P1 shifted from the axis AX2 of the reel 11B supported by the second reel support 3B toward the first reel support 3A by the radius of curvature R of the curved portion 3*a* and the position P2 of the side wall of the recess of the first reel support 3A closer to the second reel support 3B is (80×2×R)/600 or more and (120×2×R)/600 or less.

Thus, when the reels 11A to 11D are loaded into or unloaded from the reel pallet 1, it is possible to prevent the holder from colliding with the reels 11A to 11D and prevent the reels 11A to 11D from colliding with each other while preventing the reel pallet from becoming larger in size.

The same effect as described above may be obtained when the reel-to-reel distance La between the position P3 and the position P4, the reel-to-reel distance La between the position P5 and the position P6, or the reel-to-reel distance La between the position P7 and the position P8 is (80×2×R)/600 or more and (120×2×R)/600 or less.

In the present embodiment, the first modification and the second modification, as illustrated in FIG. 4, the reel-to-reel distance La between the position P1 and the position P2, the reel-to-reel distance La between the position P3 and the position P4, the reel-to-reel distance La between the position P5 and the position P6, or the reel-to-reel distance La between the position P7 and the position P8 is 10 mm or more and 140 mm or less.

Thus, when the diameter Df of the flange member 13 of each of the reels 11A to 11D is 600 mm, it is possible to prevent the reels 11A to 11D from being damaged when the reels 11A to 11D are loaded into or unloaded from the reel pallet 1, and it is possible to prevent the reel pallet 1 from becoming larger in size.

If the reel-to-reel distance La is less than 10 mm, when the reels 11A to 11D are loaded into or unloaded from the reel pallet 1, the holder may collide with the reels 11A to 11D, and the reels 11A to 11D may collide with each other. If the reel-to-reel distance La is greater than 140 mm, the distance between the reels 11A to 11D may become larger, which makes the reel pallet 1 larger in size.

In the present embodiment, the first modification and the second modification, as illustrated in FIG. 4, in the plan view, the distance Lb2 in the first direction D1 between an outer edge of the base 2 (i.e., the second side N2 of the arrangement surface 2A), which is located on the side opposite to the second reel support 3B with respect to the first reel support 3A, and the recess of the first reel support 3A, is 60 mm or less.

Thus, it is possible to make the base 2 smaller in size, which makes it possible to easily transport and store the reel pallet 1.

The same effect as described above may be obtained when the distance Lb2 between an outer edge of the base 2 (i.e., the first side N1 of the arrangement surface 2A) and the recess of the second reel support 3B, the distance Lb2 between an outer edge of the base 2 (i.e., the third side N3 of the arrangement surface 2A) and the recess of the third reel support 3C, or the distance Lb2 between an outer edge of the base 2 (i.e., the fourth side N4 of the arrangement surface 2A) and the recess of the fourth reel support 3D is 60 mm or less.

In the present embodiment, the first modification and the second modification, the base 2 and the plurality of reel supports 3A to 3D may be integrally formed.

Thus, it is possible to form the base 2 and the reel supports 3A to 3D by integral molding, which makes the reel pallet 1 high in strength.

Further, in the present embodiment, the first modification and the second modification, as illustrated in FIG. 4, each of the plurality of reel supports 3A to 3D is formed at a portion protruding from the arrangement surface 2A of the base 2.

Thus, it is possible to form the recess for inserting each of the reels 11A to 11D at the protruding portion, which makes it possible to reduce the thickness of the base 2.

In the present embodiment, as illustrated in FIG. 2, the curved portion 3*a* of each of the plurality of reel supports 3A to 3D is constituted by two curved supports 3*aa* and 3*ab* separated from each other.

Thus, it is possible to simplify the shape of the curved portion 3*a*.

In the first modification, as illustrated in FIG. 5, the curved portion 3*a* of each of the plurality of reel supports 3A to 3D is constituted by four curved supports 3*aa*, 3*ab*, 3*ac*, and 3*ad* separated from each other.

Thus, it is possible to support each of the reels 11A to 11D at four points, which makes it possible to support each of the reels 11A to 11D more stably.

The curved portion 3*a* of each of the plurality of reel supports 3A to 3D may be constituted by a single curved support.

Thus, it is possible to simplify the shape of the curved portion 3*a*, and it is also possible to increase the length for supporting each of the reels 11A to 11D along the circumferential direction.

In the second modification, as illustrated in FIG. 6, each of the plurality of reel supports 3A to 3D is formed as a recess recessed from the arrangement surface 2A of the base 2.

Thus, there is no need to provide a protruding portion on the arrangement surface 2A of the base 2, which makes it possible to simplify the shape of the reel pallet 1.

In the present embodiment, the first modification and the second modification, each of the plurality of reel supports 3A to 3D is configured to support the reels 11A to 11D wound with insulated wires.

Thus, it is possible to transport and/or store the reel pallet 1 while a plurality of reels 11A to 11D, each of which is wound with insulated wires, are being supported thereon.

It should be understood that the embodiments disclosed herein have been presented for the purpose of illustration and description but not limited in all aspects. It is intended that the scope of the present disclosure is not limited to the description above but defined by the scope of the claims and encompasses all modifications equivalent in meaning and scope to the claims.

REFERENCE SIGNS LIST

1: reel palette; 2: base; 2A: arrangement surface (upper surface); 3A: first reel support; 3B: second reel support; 3C: third reel support; 3D: fourth reel support; 3*a*: curved portion; 3*aa*, 3*ab*, 3*ac*, 3*ad*: curved support; 3*c*: bottom; 3*d*: through hole; 3*f*: side wall; 4A, 4B, 4C, 4D: tray; 11A, 11B, 11C, 11D: reel; 12: main body; 13: flange member; 21A, 21B, 21C, 21D: belt; AX1, AX2, AX3, AX4: axis; C1, C2, C3, C4: center line; D1: first direction; D2: second direction; Db: diameter of main body; Df: diameter of flange member; La: reel-to-reel distance; Lb1, Lb2: distance; N1: first side; N2: second side; N3: third side; N4: fourth side; P1, P2, P3, P4, P5, P6, P7, P8: position; R: radius of curvature; Tf: thickness of flange member; Wb: width of main body

The invention claimed is:

1. A reel pallet, at least a surface of which is made of resin, the reel pallet comprising:

a base having an arrangement surface; and a plurality of reel supports formed on the arrangement surface of the base, wherein:

the plurality of reel supports includes a first reel support, a second reel support, a third reel support, and a fourth reel support, in a first direction in which the first reel support and the second reel support are adjacent to each other, the third reel support and the fourth reel support are adjacent to each other in the first direction, the first reel support and the third reel support are adjacent to each other in a second direction intersecting the first direction, and the second reel support and the fourth reel support are adjacent to each other in the second direction, an axis of a reel supported by the first reel support and an axis of a reel supported by the fourth reel support extend in the first direction, and an axis of a reel supported by the second reel support and an axis of a reel supported by the third reel support extend in the second direction, when a distance in the first direction between the reel supported by the first reel support and the reel supported by the second reel support is denoted by La, a distance in the first direction between an outer edge of the reel supported by the second reel support and located on the side opposite to the first reel support and an outer edge of the base is denoted by Lb1, and a distance in the first direction between an end surface of the reel supported by the first reel support and located on the side opposite to the second reel support and an outer edge of the base is denoted by Lb2, the reel pallet satisfies a relationship of $1<La/(Lb1+Lb2)<3$, a plurality of trays constitute the plurality of reel supports respectively and each tray of the plurality of trays is configured to be separately attachable to and detachable from the arrangement surface of the base, and the plurality of trays are configured as trays separate from each other.

2. The reel pallet according to claim 1, wherein each of the plurality of reel supports is formed with a recess into which a reel is loaded, and the recess includes a curved portion which supports the reel in the recess, and in a plan view when viewed from a direction orthogonal to the arrangement surface, a reel-to-reel distance La in the first direction between a position shifted from the axis of the reel supported by the second reel support toward the first reel support by a radius of curvature R of the curved portion and a position of a side wall of the recess of the first reel support closer to the second reel support is $(80\times2\times R)/600$ or more and $(120\times2\times R)/600$ or less.

3. The reel pallet according to claim 2, wherein the reel-to-reel distance La is 10 mm or more and 140 mm or less.

4. The reel pallet according to claim 3, wherein in the plan view, the distance in the first direction between an outer edge of the base, which is located on the side opposite to the second reel support with respect to the first reel support, and the recess of the first reel support, is 60 mm or less.

5. The reel pallet according to claim 2, wherein each of the plurality of reel supports is formed at a portion protruding from the arrangement surface of the base.

6. The reel pallet according to claim 5, wherein the curved portion of each of the plurality of reel supports is constituted by two curved supports separated from each other.

7. The reel pallet according to claim 5, wherein the curved portion of each of the plurality of reel supports is constituted by four curved supports separated from each other.

8. The reel pallet according to claim 5, wherein the curved portion of each of the plurality of reel supports is constituted by a single curved support.

9. The reel pallet according to claim 1, wherein the base and the plurality of reel supports are integrally formed.

10. The reel pallet according to claim 1, wherein each of the plurality of reel supports is formed as a recess recessed from the arrangement surface of the base.

11. The reel pallet according to claim 1, wherein each of the plurality of reel supports is configured to support a reel wound with insulated wires.

* * * * *